United States Patent [19]

DeHart et al.

[11] 4,016,980

[45] Apr. 12, 1977

[54] DEVICE FOR CHECKING ENVELOPES FOR ENCLOSED DOCUMENTS

[75] Inventors: John R. DeHart, Coral Gables, Fla.; Larry L. Nelson, Redwood City, Calif.

[73] Assignee: Docutronix, Inc., Homestead, Fla.

[22] Filed: May 9, 1975

[21] Appl. No.: 576,104

[52] U.S. Cl. ..... 209/111.7 T; 209/74 M; 250/223 R; 356/73

[51] Int. Cl.[2] ..... B07C 5/10

[58] Field of Search ..... 209/73, 74 R, 74 M, 209/111.7 T, DIG. 1, 111.7 R; 271/259; 250/222 R, 223 R, 224, 214 AG; 356/204, 205, 206, 73

[56] References Cited

UNITED STATES PATENTS

| | | | |
|---|---|---|---|
| 3,003,631 | 10/1961 | Stock | 209/111.7 T X |
| 3,052,350 | 9/1962 | Marcovitz et al. | 209/74 R |
| 3,365,699 | 1/1968 | Foster | 209/74 R X |
| 3,496,370 | 2/1970 | Haville et al. | 209/DIG. 2 |
| 3,799,337 | 3/1974 | Green | 209/111.7 T |
| 3,827,812 | 8/1974 | Heimman | 209/111.7 T X |

*Primary Examiner*—Robert B. Reeves
*Assistant Examiner*—Joseph J. Rolla
*Attorney, Agent, or Firm*—McCormick, Paulding & Huber

[57] ABSTRACT

A device for inspecting envelopes for enclosed contents consists of a conveyor for feeding the envelopes one at a time past an inspection station whereat the opacity of an envelope is sensed at two zones spaced from one another along a line perpendicular to the direction of envelope movement. The signals produced by the sensors are processed to produce a signal indicating the suspected presence of a document within an envelope as a result of differences in the opacities sensed by the two sensors and caused by such enclosed document, the system however compensating for opacity changes caused by seams in the envelopes and by differences in the opacities of the materials from which different envelopes are made. A gate mechanism operable in response to the production or non-production of a suspect signal as each envelope passes the inspection station segregates envelopes suspected of containing documents from those not so suspected.

14 Claims, 5 Drawing Figures

DEVICE FOR CHECKING ENVELOPES FOR ENCLOSED DOCUMENTS

BACKGROUND OF THE INVENTION

This invention relates to envelope handling equipment and deals more particularly with such equipment for checking a plurality of envelopes for the presence of enclosed documents.

The device of this invention may be used in various different applications where it is necessary or desirable to inspect a large number of envelopes for the presence of enclosed documents and for segregating from the remainder of the envelopes those suspected, as a result of the inspection, of containing documents. For example, many businesses, government agencies, and other institutions have mail receiving or similar departments to which documents such as checks, bills, order forms, receipts and the like are delivered in sealed delivery or mailing envelopes. After receipt of the envelopes, they are opened and their contents extracted. After such extraction the envelopes are normally considered waste and are suitably disposed of. The envelope opening and content extracting processes may be carried out either by hand or through the use of automatic machinery; but, in either case, it is possible that some mistakes may be made causing some forwarded documents to be unextracted from their envelopes and to be accordingly consigned to waste with the envelopes and destroyed. The device of this invention is particularly useful in this situation for checking previously opened and supposedly emptied envelopes and for retrieving those suspected of containing enclosed documents prior to their destruction.

The device of the invention relies upon sensing the opacity of an envelope for determining the presence or absence of a document in an envelope passing an inspection station. The use of opacity sensors for detecting the presence of enclosed documents within envelopes has been known in the past, and basically involves the fact that the opacity of an envelope containing an enclosed document is greater than that of one not containing a document. However, problems in reliably detecting the presence of enclosed documents by opacity sensors are presented by the fact that the opacity of any given envelope itself varies over its body due to the presence of seams in the envelope where two or more portions of the envelope blank are overlaped and secured to one another by adhesive, and the fact that the opacities of the envelopes in any given group may vary widely from one envelope to another because of differences in the sheet materials from which the various envelopes are made.

The device of this invention overcomes these problems and provides reliable document detection by compensating for opacity differences due to seams and for opacity differences in the sheet materials from which individual envelopes are made.

Other objects and advantages of the invention will be apparent from the following description and from the drawings forming a part hereof.

SUMMARY OF THE INVENTION

The invention resides in a device for checking a plurality of generally rectangular envelopes, which may have previously been opened and supposedly emptied, for enclosed documents. The device consists of a means for feeding the envelopes one at a time past an inspection station having two opacity sensors arranged to detect the opacity of each envelope along two of its edges which are parallel to its direction of movement. Connected to these sensors is a signal processing circuit which processes the opacity signals to produce a suspect signal in the event the two opacity signals differ from one another by a substantial amount for a predetermined time greater than that required for a typical envelope seam to move past the inspection station and less than that required for the envelope itself to pass the station. A gate mechanism located downstream of the inspection station is controlled by a logic and delay circuit, in turn responsive to suspect signals, to direct envelopes for which suspect signals are produced to one destination and to direct envelopes for which no suspect signals are produced to another destination. The logic and delay circuit is also in part responsive to signals produced by a third sensor at the inspection station, in line with the two opacity sensors, providing signals indicating the passage of leading and trailing edges of envelopes past the inspection station.

The invention additionally resides in each of the two opacity sensors including a means for adjusting the level of the output signal produced thereby in response to a given sensed opacity, and a calibration circuit responsive to suspect signals produced when known empty envelopes are moved past said inspection station for indicating the need to adjust the level of one or the other of said opacity sensors to thereafter avoid the production of such suspect signals when empty envelopes pass the inspection station.

DETAILED DESCRIPTION OF THE PREFERRED EMBODIMENT

Figure 1:
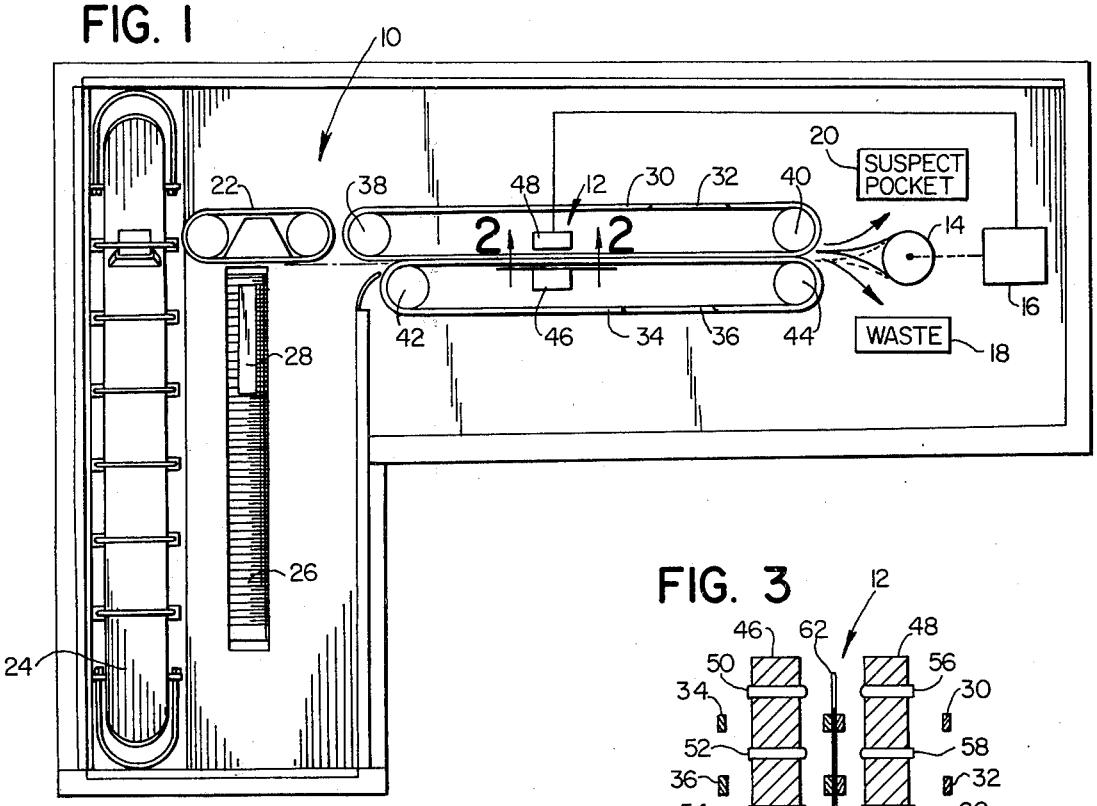
FIG.1 is a plan view, partly diagrammatic, of an envelope handling device embodying the present invention.

Referring to FIG. 1, the device there shown comprises a feeding mechanism, indicated generally at 10, for feeding a plurality of envelopes one at a time past an inspection station 12, and two position gate 14 located downstream of the inspection station. The gate 14 is operable by a control system 16 responsive to the output from the inspection station 12 to condition the gate 14 to direct an envelope moving from the inspection station to either a waste destination 18, corresponding to the solid line showing of the gate, or to a suspect pocket 20, corresponding to the broken line showing of the gate.

The device of FIG. 1 is one intended for use with generally rectangular envelopes, the feeder mechanism for moving the envelopes past the inspection station 12 being one such that each envelope is moved in the direction of the arrows with two of its edges vertical and perpendicular to the direction of movement and with its other two edges horizontal and parallel to the direction of movement, there further being a space between the trailing edge of one envelope and the leading edge of the next. Various different feeders may be used to perform the feeding function, but, preferably and as shown, the feeder 10 is similar to that of U.S. Pat. No. 3,647,203 to which reference may be had for further details of its construction.

For the present purposes, it is sufficient to note that the feeder 10 includes a continuously moving endless vacuum transfer belt 22, a travelling rack 24 and a rotating screw 26. Both the rack 24 and the screw 26 urge a stack of envelopes forwardly toward the vacuum belt 22, the envelopes in the stack being oriented vertically in flatwise juxtaposition to one another each with its lower horizontal edge resting on and spanning both the rack 24 and the screw 26. Along a part of its length, the screw 26 has a flat 28 which, as the screw rotates, jogs the envelopes causing the contents, if any, of the envelopes to tend to move towards the lower horizontal edges of the envelopes in which they are contained.

Figure 2:
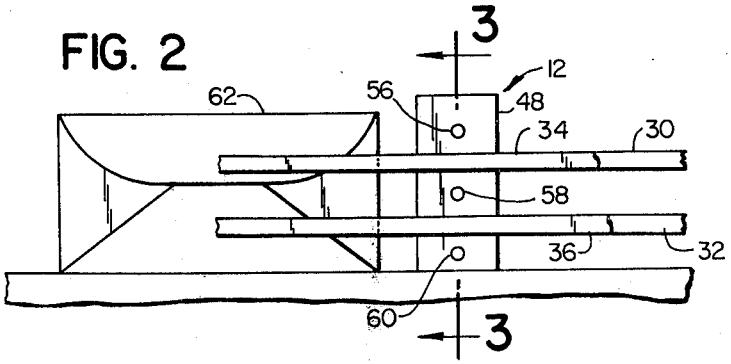
FIG. 2 is an enlarged fragmentary vertical sectional view taken on the line 2—2 of FIG. 1.

The vacuum belt 22 successively shifts the forwardmost envelope of the stack away from the stack, to the right in FIG. 1, into the nip of a set of conveyor belts 30, 32, 34 and 36 which move each envelope at constant velocity past the inspection station 12 and toward the gate 14. The two belts 30 and 32, as also shown in FIG. 2, are vertically spaced and parallel from one another and are trained over two rolls 38 and 40, one of which is driven at a constant angular velocity. Likewise, the two belts 34 and 36 are vertically spaced and parallel to one another and are trained over two rolls 42 and 44, one of which is driven at the same constant velocity as the driven one of the rolls 38 and 40.

Figure 3:
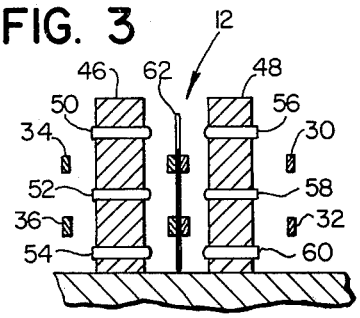
FIG. 3 is a vertical sectional view taken on the line 3—3 of FIG. 2.

The inspection station 12 consists of a set of three opacity sensors each consisting of a lamp or other light source and a photosensitive detector, the light source and the detector being so arranged that an envelope 62 moving past the inspection station moves between the light source and the detector so the amount of light received by the detector during such time is dependent on the envelope's opacity. In particular, the illustrated inspection station 12, as shown in FIGS. 1, 2 and 3, has two housings or mounts 46 and 48 located respectively on opposite sides of the path of envelope travel. The mount 46 includes three lamp units 50, 52 and 54 and the mount 48 includes three photosensitive detectors 56, 58 and 60.

The lamp unit 50 and detector 56 together comprise a "top" sensor for sensing the opacity of a small discrete field located between the lamp 50 and the detector 56. The position of this sensed field is such that as an envelope 62 moves past the inspection station, the sensed field is located a small distance inboard or downwardly of the top horizontal edge of the envelope. Likewise, the bottom lamp 54 and its associated photosensitive detector 60 form a "bottom" sensor for sensing the opacity of a small discrete field located slightly inboard or above the lower horizontal edge of an envelope passing the inspection station.

The lamp 54 and detector 58 form a third sensor having a sensed field vertically in line with and between the fields of the other two sensors. This third sensor is used, as hereinafter explained in more detail, to provide signals indicating the passage of envelope leading and trailing edges past the inspection station.

Figure 4:
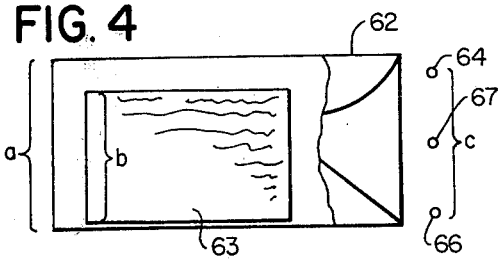
FIG. 4 is a view showing the relationship between the width of an envelope, the width of an enclosed document and the corresponding spacing of the two opacity sensors.

FIG. 4 shows in more detail the preferred arrangement and spacing of the top and bottom sensed fields relative to an envelope 62 passing the inspection station and having an enclosed document 63. In this figure, the width of the envelope is indicated at *a* and the width of the enclosed document is indicated at *b*. The field of the top sensor is indicated at 64, the field of the bottom sensor at 66 and the field of the leading and trailing edge sensor at 67. The spacing between the top and bottom fields 64 and 66 is indicated at *c*. This spacing *c* is greater than the document width *b* but less than the envelope width *a*.

Thus, ignoring seams in the envelope, if an empty envelope moves past the inspection station, the top and bottom sensors will put out substantially equal opacity signals during the movement of the envelope past the station. On the other hand, if an envelope containing a document 63 moves past the inspection station, the top sensor will detect a less dense opacity than the bottom sensor during the time that the document passes the inspection station, and the two sensors will put out correspondingly different opacity signals. As hereinafter explained in more detail, the opacity signals are processed so as to produce a further signal indicating the suspected presence of a document in an envelope in response to a substantial difference in the top and bottom opacity signals. The presence of seams in an envelope passing the inspection station also cause momentary differences in the outputs of the top and bottom opacity sensors; however, these momentary differences are rejected or compensated for by requiring a difference in signals to appear for a predetermined time, longer than that required for the passage of a typical seam, before a suspect signal is produced. Further, since the production of a suspect signal is dependent on a difference in the output from the two top and bottom sensors, common rises or falls in both signals as caused by different opacities of the envelope material, from one envelope to another, do not give rise to suspect signals.

Figure 5:
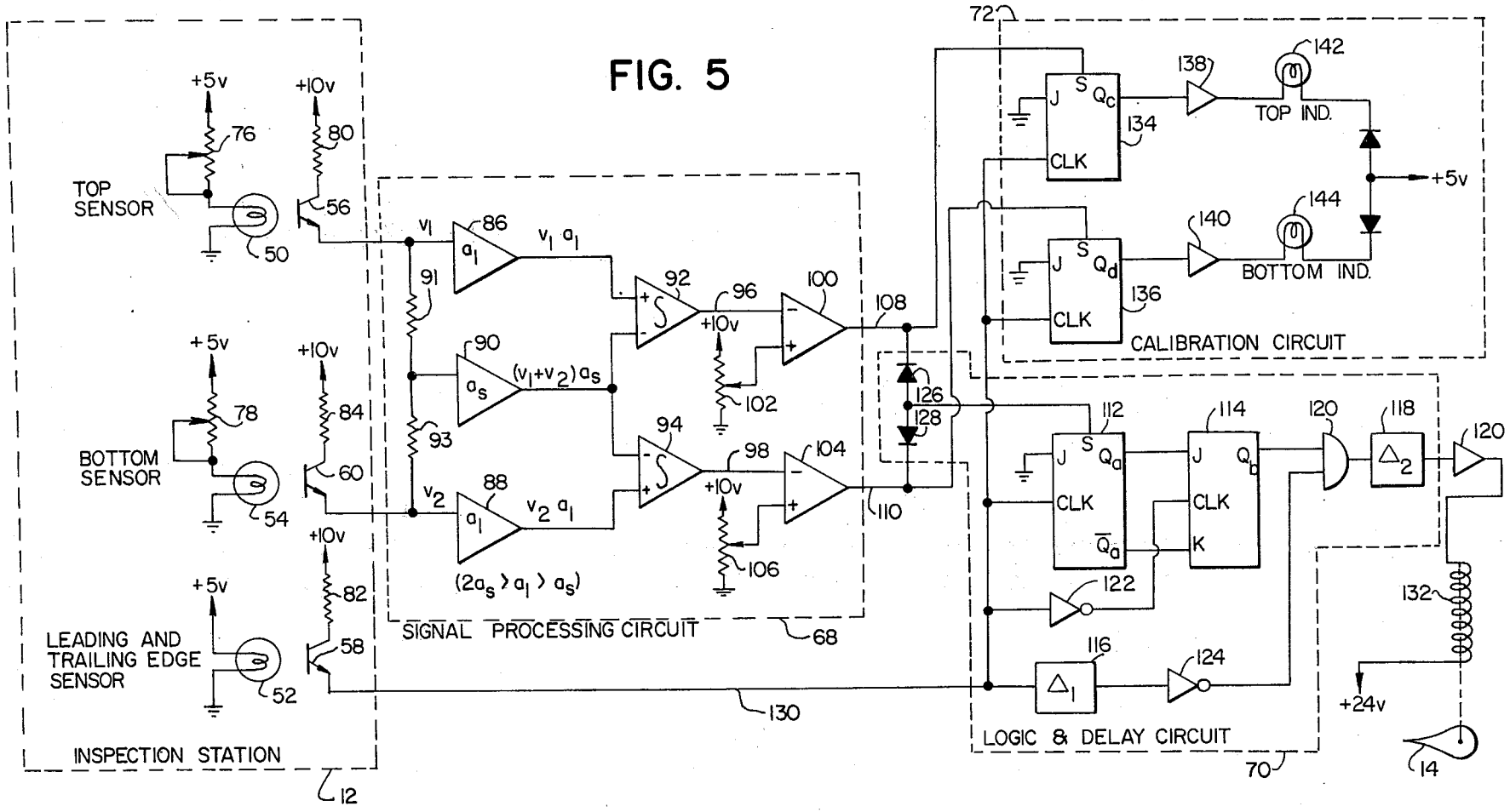
FIG. 5 is a schematic wiring diagram of a portion of the device of FIG. 1.

Referring to FIG. 5, this figure shows the wiring diagram of the inspection station, and of a signal processing circuit 68, a logic and delay circuit 70 and a calibration circuit 72, associated with the inspection station 12 and gate mechanism 14. Considering first the inspection station, the top lamp 50 and bottom lamp 54 are both energized from a positive voltage source through manually adjustable resistors, 74 and 76 respectively, whereby the intensity of the light emitted from each lamp may be varied. The lamp 52 does not include any means for adjusting its intensity and is directly connected to the positive voltage source. The photosensitive detectors 56, 58 and 60 are phototransistors having their collectors connected to another positive voltage source through suitable resistors 80, 82 or 84, respectively. Accordingly, the output voltage appearing at the emitter of each phototransistor is an opacity signal having a voltage value inversely dependent on the opacity of the associated sensed field.

The two opacity voltage signals, $v_1$ and $v_2$, produced by the top and bottom sensors of the inspection station are transmitted to the signal processing circuit 68. This latter circuit includes three operational amplifiers 86, 88 and 90. The two amplifiers 86 and 88 each have the same gain $a_1$ and the amplifier 90 has a gain $a_s$. The top opacity signal $v_1$ is supplied directly to the amplifier 86 so that the output therefrom is $v_1a_1$, and likewise the bottom voltage signal $v_2$ is supplied directly to the amplifier 88 so that the output therefrom is $v_2a_1$. Both signals $v_1$ and $v_2$ are also supplied to the amplifier 90 through the resistors 91 and 93 connected as shown so that the output of the amplifier 90 is the sum of the two signals times the gain $a_s$, or is $(v_1 + v_2)a_s$. The gains $a_1$ and $a_s$ are further so related to one another that $2a_s > a_1 > a_s$. For example, the gain $a_1$ of each of the two amplifiers 86 and 88 may be equal to 1.8 and the gain $a_s$ of the amplifier 90 may be equal to 1.0. Thus, if the opacity signals $v_1$ and $v_2$ are equal, the output of the summing amplifier 90 will be greater than the output from either one of the amplifiers 86 and 88. If the opacity signals $v_1$ and $v_2$ are substantially different from one another, the output from one of the amplifiers 86 and 88 will be greater than the output of the summing amplifier.

The outputs of the three amplifiers 86, 88 and 90 are fed to two other operational amplifiers 92 and 94, each of which is connected with proper external circuit components (not shown) to function as a comparator and integrator. The outputs of the two amplifiers 86 and 88 are connected respectively to the non-inverting (+) terminals of the two amplifiers 92 and 94, and the output of the summing amplifier 90 is connected to the inverting (−) terminal of each of amplifier 92 and 94. Each amplifier 92 and 94 compares the two voltages appearing as its two input terminals and if the voltage at the non-inverting terminal exceeds that at the inverting terminal, a voltage difference signal, having a set voltage level, is produced which is integrated to provide an integrated voltage signal, on the associated output line 96 or 98, which is proportional to the time integral of the voltage difference signal.

The signal appearing on the line 96 is supplied to the inverting (−) terminal of a comparing amplifier 100, the non-inverting terminal (+) of which is supplied with an adjustable reference voltage by a potentiometer 102. In similar fashion, the line 98 is connected to the inverting terminal of a comparing amplifier 104 having an adjustable reference voltage supplied to its non-inverting terminal by a potentiometer 106. When the integrated voltage signal in the line 96 exceeds the reference voltage signal supplied by the potentiometer 102, the amplifier 100 produces a suspect signal of negative voltage on the output line 108. When the integrated voltage signal on the line 98 exceeds the reference voltage supplied by the potentiometer 106 the amplifier 104 likewise produces a suspect signal of negative voltage on the ine 110.

From the foregoing, it will be understood that the signal processing circuit 68 functions in such a manner that when the two opacity signals, $v_1$ and $v_2$, are of substantially equal values, during movement of an envelope past the inspection station, no suspect signal will be produced on either the line 108 or 110. On the other hand, if the opacity signals $v_1$ and $v_2$ are substantially different from one another, then one or the other of the two amplifiers 92 and 94 will produce an integrated voltage signal on one or the other of the output line 96 and 98. This integrated voltage signal starts at a given voltage level and changes linearly with time toward the reference voltage supplied by the associated potentiometer. Therefore, some given amount of time will be required for the integrated voltage signal to reach the reference voltage, and the amount of time so required may be adjusted by adjusting the associated potentiometer 102 or 106 to change the reference voltage. In particular, the setting of each potentiometer is such that the time required for the integrated voltage signal to reach the reference voltage is greater than that required for a typical envelope seam to pass by the inspection station but is less than that required for a typical enclosed document to pass the inspection station. Typically, the length of an envelope seam, in the direction of envelope movement is about one half inch, and, therefore, the predetermined time should be greater than that required for the envelope to travel one half inch. Potentiometer settings resulting in the predetermined time being equal to 2 to 3 inches of envelope travel are preferred. Accordingly, a suspect signal is produced on the line 108 or the line 110 only in the event a difference in opacity signals $v_1$ and $v_2$ persists for sufficient amount of time to ignore or reject envelope seams.

The logic and delay circuit 70 controls the gate 14 in response to the production or non-production of suspect signals during the passage of envelopes past the inspection station, it introducing a first delay $\Delta_1$ to allow for the time required for an envelope to pass from the inspection station to the gate and a second delay $\Delta_2$ to allow for the amount of time required for an envelope to pass completely through the gate. As to its details, the circuit 70 includes two J-K flip-flops 112 and 114, two monostable multivibrators 116 and 118 providing the delays $\Delta_1$ and $\Delta_2$, respectively, an AND gate 120 and two inverters 122 and 124. The J terminal of the flip-flop 11 is grounded and the two lines 108 and 110 are connected to the set terminal of the flip-flop 112 through two diodes 126 and 128 so that when a suspect signal appears on either of the lines 108 or 110 the flip-flop 112 is set to a logical 1 at its output terminal $Q_a$. The output of the leading and trailing edge sensor is connected by the line 130 directly to the clock terminal of the flip-flop 112 and to the monostable multivibrator 116, and through the inverter 122 to the clock terminal of the flip-flop 114.

Turning to the functioning of the logic and delay circuit 70, when a leading edge of an envelope passes the leading and trailing edge sensor of the inspection station 12, a signal is produced on the line 130 which sets the flip-flop 112 to a logical 0 at its $Q_a$ terminal and triggers the multivibrator 116 to start the running of its delay period $\Delta_1$. If no suspect signal is produced before the next leading edge signal, the multivibrator 116 will time out. Nothing further however happens, and the solenoid 132 which operates the gate 114 remain unenergized and the gate 114 will remain in the solid line position of FIG. 1 at which the envelope in question will be directed to the waste destination.

Assume now, however, that an envelope containing an enclosed document passes the inspection station. As the trailing edge of the envelope passes the leading and trailing edge sensor, a leading edge signal is produced which sets the $Q_a$ terminal of flip-flop 112 to 0 and starts the running of delay $\Delta_1$. Subsequently, and before the trailing edge of the envelope passes the inspection station, a suspect signal appears on the line 108 or the line 110 and sets the $Q_a$ terminal of flip-flop 112 to a logical 1. Still subsequently, the trailing edge of the envelope passes the leading and trailing edge sensor of the inspection station and produces a signal on the line 130 which, through the inverter 122, is applied to the clock terminal of the flip-flop 114 to cause the logical 1 of the terminal $Q_a$ to be transferred to the terminal $Q_b$. This enables the AND gate 120 so that when the multivibrator 116 now times out, the end of delay signal produced by the multivibrator 116 and the associated inverter 124 passes through the AND gate to trigger the multivibrator 118. The delay period $\Delta_1$ is such that at the end of it the leading edge of the envelope will be positioned immediately in advance of the gate 14. When the multivibrator 118 is triggered into its delay $\Delta_2$ the output therefrom is amplified by an amplifier 120 to energize the solenoid 132 to shift the gate 14 to the broken line position of FIG. 1 whereat the envelope in question is directed to the suspect pocket. The delay $\Delta_2$ is slightly longer than that required for the envelope in question to pass, from leading edge to trailing edge, past the gate 14 so that immediately after the envelope's passing the gate, the delay period $\Delta_2$ ends and the solenoid 132 is de-energized to return the gate 14 to its original position.

The calibration circuit 72 is provided to facilitate the adjustment of the sensitivities of the top and bottom opacity sensors of the inspection station 12 to optimize the performance of the overall device. This calibration circuit includes two J-K flip-flops 134 and 136 each controlling an associated amplifier 138 or 140 and an associated indicator lamp 142 or 144. The clock terminal of each flip-flop 134 and 136 is connected to the output line 130 of the leading and trailing edge sensor, and the J terminal of each flip-flop is grounded, so that when a leading edge signal appears on the line 130, the $Q_c$ terminal of the flip-flop 134 and the $Q_d$ terminal of the flip-flop 136 are both set to zero. The set terminal of the flip-flop 134 is connected to the line 108, associated with the top opacity sensor, and likewise the set terminal of the flip-flop 136 is connected to the line 110, associated with the bottom opacity sensor.

In using the calibration circuit 72, a stack of known empty envelopes are placed in the feeder 10 of FIG. 1 and run past the inspection station 12. If the top and bottom opacity sensors of the inspection station are properly adjusted, no suspect signals will be produced on either the line 108 or the line 110, neither of the flip-flops 134, 136 will become set, and neither of the indicator lights 142 or 144 will light. On the other hand, if the sensors are not properly adjusted, the voltages $v_1$ and $v_2$ will differ from one another as the empty envelopes pass the inspection station and suspect signals will be produced on either the line 108 or 110. If the suspect signals appear on the line 108, the flip-flop 134 will be repetitively set and reset as the envelopes pass the inspection station and the top indicator light 142 will flash. On the other hand, if the suspect signals appear on the line 110, the flip-flop 136 will be repetitively set and reset and the bottom indicator light 144 will flash. By noting which light, if any, flashes, the operator may adjust the proper potentiometer 76 or 78 to shift the sensitivity of the associated opacity sensor to bring the device to the desired condition whereat no suspect signals are produced for empty envelopes.

We claim:

1. A device for checking a plurality of generally rectangular envelopes for enclosed documents, said device comprising means for feeding said envelopes one at a time past an inspection station at a substantially constant velocity with each of said envelopes being oriented so that two of its edges are leading and trailing edges, respectively, both perpendicular to its direction of movement and its remaining two edges are parallel to said direction of movement, and a detection means at said inspection station, said detection means comprising two sensors spaced from one another along a line generally parallel to the plane of said envelopes and perpendicular to said direction of envelope movement, said two sensors being opacity sensors each producing an electrical output signal which varies with the opacity of an associated discrete sensed field, said two opacity sensors being arranged so that as said envelopes are moved past said inspection station the field sensed by one of said sensors is located inboard of one of said two remaining edges of each envelope and said field sensed by the other of said sensors is located inboard of the other of said remaining edges of each envelope, and means responsive to variations of the integral with respect to time of the difference in the values of the output signals of said two opacity sensors for producing a suspect signal indicating the suspected presence of a document in the envelope producing such suspect signal.

2. A device as defined in claim 1 further characterized by said means responsive to variations of the integral with respect to time of the difference in the values of the output signals of said two opacity sensors being such that a suspect signal is produced only in the event a substantial difference in the values of the output signals of said two opacity sensors persists for a time greater than that required for an envelope to travel one half inch at said constant velocity.

3. A device as defined in claim 1 further characterized by a gate mechanism downstream of said inspection station operable in response to a suspect signal to direct an associated envelope to one destination and operable in response to the lack of a suspect signal to direct an associated envelope to another destination.

4. A device as defined in claim 1 further characterized by a third sensor located generally along said line generally perpendicular to said direction of envelope travel for producing leading edge and trailing edge electrical signals indicative respectively of the passage of leading and trailing edges of said envelopes past said inspection station, a mechanical gate mechanism downstream of said inspection station alternately conditionable to direct an envelope to one or the other of two destinations, and a logic and delay circuit for controlling said gate mechanism in response to suspect signals such as the one aforesaid and to said leading edge and trailing edge signals produced by said third sensor for controlling said gate mechanism in such a manner as to condition it to direct any envelope for which suspect signal is produced to said one destination and to direct any envelope for which no suspect signal is produced to said other destination.

5. A device as defined in claim 4 further characterized by all three of said sensors consisting of a photoelectric cell and a light source for directing light rays toward said photo-electric cell, said photo-electric cell and said light source being located on opposite sides of the path of movement of said envelopes.

6. A device as defined in claim 1 further characterized by a third sensor located along said line generally perpendicular to said direction of envelope movement for producing an electrical output signal which shifts from a first value to a second value as the leading edge of an envelope passes said inspection station and which reverts from said second value to said first value as the trailing edge of the same envelope passes said inspection station, a first flip-flop having an output terminal $Q_a$ and which flip-flop is so constructed and so connected with said third sensor and with said suspect signal producing means that each time an envelope leading edge passes said inspection station the output of said output terminal $Q_a$ is reset to a logical 0 and each time a suspect signal appears the output of said output terminal $Q_a$ is set to a logical 1, a second flip-flop having an output terminal $Q_b$ and which second flip-flop is so constructed and so connected with said first flip-flop and with said third sensor that each time an envelope trailing edge passes said inspection station the output then appearing at said output terminal $Q_a$ is taken on as the output of said output terminal $Q_b$, a first time delay means having a first time delay period and so constructed and so connected with said third sensor as to be triggered into the running of said first time delay period as the leading edge of an envelope passes said inspection station, a second time delay means having a second time delay period, means for triggering said second time delay means into the running of said second time delay period upon the completion of the running of said first time delay period only if the output of said output terminal $Q_b$ is then a logical 1, a mechanical gate mechanism downstream of said inspection station alternately conditionable to direct an envelope to one or the other of two destinations, and means for controlling said mechanical gate mechanism in response to the state of said second delay means whereby said gate mechanism is conditioned to direct an envelope to said one destination during the running of said second delay period and is conditioned to direct an envelope to said second destination during the non-running of said second delay period.

7. A device as defined in claim 6 further characterized by said first delay period being substantially equal to the amount of time required for the leading edge of an envelope travelling at said constant velocity to move from said inspection station to said gate mechanism, and said second time delay period being substantially equal to the amount of time required for an envelope travelling at said constant velocity to pass through said gate mechanism.

8. A device as defined in claim 1 further characterized by each of said two opacity sensors consisting of a photo-electric cell and a light source for directing light rays toward said photo-electric cell, said photo-electric cell and said light source being located on opposite sides of the path of movement of said envelopes.

9. A device as defined in claim 8 further characterized by a manually operable means associated with said light source of each of said sensors for adjustably varying the intensity of said light source, and a calibration circuit responsive to suspect signals produced when known empty envelopes are moved past said inspection station for indicating the need to adjust said intensity of said light source of one or the other of said sensors to thereafter avoid the production of such suspect signals when empty envelopes pass said inspection station.

10. A device for checking a plurality of generally rectangular envelopes for enclosed documents, said device comprising means for feeding envelopes one at a time past an inspection station at a substantially constant velocity with each of said envelopes being oriented so that two of its edges are leading and trailing edges, respectively, both perpendicular to its direction of movement and its remaining two edges are parallel to said direction of movement, and detection means at said inspection station, said detection means comprising two sensors spaced from one another along a line generally parallel to said envelopes and perpendicular to said direction of envelope movement, said two sensors being opacity sensors for producing electrical output voltage signals, $v_1$ and $v_2$ respectively, each of which varies generally proportionally with the opacity of an associated discrete sensed field, said two opacity sensors being arranged so that as said envelopes are moved past said inspection station the field sensed by one of said sensors is located inboard of one of said two remaining edges of each envelope and said field of the other of said sensors is located inboard of the other of said two remining edges of said envelope, means for summing the output signals from said two opacity sensors and for multiplying the sum by a constant $a_s$ to obtain the quantity $(v_1 + v_2)a_s$, means for multiplying each of said output signals from said opacity sensors by a constant $a_1$, where $2a_s > a_1 > a_s$, to obtain the two quantities $v_1a_1$ and $v_2a_1$, means for comparing $v_1a_1$ with $(v_1 + v_2)a_s$ and for comparing $v_2a_1$ with $(v_1 + v_2)a_s$ and for producing an opacity voltage difference signal if either $v_1a_1 > (v_1 + v_2)a_s$ or $v_2a_1 > (v_1 + v_2)a_s$, integrating means for producing an integrated voltage signal proportional to the time integral of said opacity voltge difference signal, and means for comparing said integrated voltage signal with a predetermined reference voltage and for producing a suspect signal when said integrated voltage signal exceeds said reference voltage.

11. A device as defined in claim 10 further characterized by said constant velocity, said reference voltage, and the characteristics of said integrating means being such that said opacity difference signal need be present for a time duration equal to at least one half inch of movement of an envelope at said constant velocity for said integrated voltage signal to reach said reference voltage and produce said suspect signal.

12. A device as defined in claim 11 further characterized by said time duration being equal to that required for movement of an envelope between 2 to 3 inches at said constant velocity.

13. A device as defined in claim 10 further characterized by said integrating means including a first integrating circuit for producing an integrated voltage signal such as aforesaid when $v_1a_1 > (v_1 + v_2)a_s$ and a second integrating circuit for producing an integrated voltage signal such as aforesaid when $v_2a_1 > (v_1 + v_2)a_s$, said means for comparing said integrated voltage signal with a predetermined voltage and for producing a suspect signal such as aforesaid comprising a first comparison means for comparing the integrated voltage signal produced by said first integrating circuit with a predetermined reference voltage and a second comparison circuit for comparing the output of said second integrating circuit with a predetermined reference voltage, each of said two opacity sensors including a manually operable means associated therewith for adjusting the level of the associated output signal produced by a given opacity of the associated discrete sensed field, a third sensor located along said line generally perpendicular to said direction of envelope movement for producing an electrical output signal which shifts from a first value to a second value as the leading edge of an envelope passes said inspection station and which reverts from said second value to said first value as the trailing edge of the same envelope passes said inspection station, and a calibration circuit for indicating needed adjustment of the output level of one or the other of said two opacity sensors to avoid production of a suspect signal when empty envelopes pass said inspection station, said calibration circuit comprising a first flip-flop having an output terminal $Q_c$ and which flip-flop is so constructed and so connected with said third sensor and with said first comparison circuit that each time said first comparison circuit produces an output signal said first flip-flop is set to produce a logical 1 at said terminal $Q_c$ and each time said third sensor produces a signal indicating passage of a leading edge of an envelope past said inspection station said first flip-flop is reset to produce a logical 0 at said output terminal $Q_c$, a second flip-flop having an output terminal $Q_d$ which second flip-flop is so constructed and so connected with said second comparison circuit and with said third sensor that each time an output signal is produced by said second comparison circuit said second flip-flop is set to produce a logical 1 at said output terminal $Q_d$ and each time said third sensor produces a signal indicating the passage of a leading edge past said inspection station said second flip-flop is reset to produce a logical 0 at said output terminal $Q_d$, a first binary indicating device connected with said output terminal $Q_c$ for visually indicating the logic level of the output signal appearing at said output terminal $Q_c$, and a second binary indicating device connected with said output terminal $Q_c$ for visually indicating the logic level of the output signal appearing at said output terminal $Q_d$.

14. A device as defined in claim 13 further characterized by a mechanical gate mechanism downstream of said inspection station alternately conditionable to direct an envelope to one or the other of two destinations, and a logic and delay circuit for controlling said gate mechanism in response to suspect signals such as the one aforesaid and to said leading and trailing edge signals produced by said third sensor for controlling said gate mechanism in such a manner as to condition it to direct envelope for which a suspect signal is produced to said one destination and to direct any envelope for which no suspect signal is produced to said other destination.

* * * * *